US010773366B2

(12) United States Patent
Kamimoto et al.

(10) Patent No.: US 10,773,366 B2
(45) Date of Patent: Sep. 15, 2020

(54) DRIVING TOOL

(71) Applicant: MAKITA CORPORATION, Anjo-shi, Aichi (JP)

(72) Inventors: Junpei Kamimoto, Anjo (JP); Noriyuki Nishido, Anjo (JP)

(73) Assignee: MAKITA CORPORATION, Anjo (JP)

( * ) Notice: Subject to any disclaimer, the term of this patent is extended or adjusted under 35 U.S.C. 154(b) by 205 days.

(21) Appl. No.: 16/020,583

(22) Filed: Jun. 27, 2018

(65) Prior Publication Data

US 2019/0022841 A1 Jan. 24, 2019

(30) Foreign Application Priority Data

Jul. 19, 2017 (JP) ..... 2017-139949

(51) Int. Cl.
*B25C 1/04* (2006.01)

(52) U.S. Cl.
CPC ..... *B25C 1/047* (2013.01); *B25C 1/044* (2013.01)

(58) Field of Classification Search
CPC .. B25C 1/047; B25C 7/00; B25C 1/04; B25C 1/08; B25C 1/14; B25C 1/143
USPC ..... 227/130, 9, 10
See application file for complete search history.

(56) References Cited

U.S. PATENT DOCUMENTS 3,905,535 A * 9/1975 Novak ..... B25C 1/008 227/120
4,091,981 A * 5/1978 Moriguchi ..... B25C 1/001 227/130
7,290,691 B1 * 11/2007 Wen ..... B25C 1/041 227/130
7,448,524 B1 * 11/2008 Liang ..... B25C 1/044 227/120
8,777,078 B2 * 7/2014 Kakuda ..... B25C 1/08 227/110
9,827,659 B2 * 11/2017 Matsuno ..... B25C 1/04
2005/0072585 A1 * 4/2005 Kamo ..... B25B 21/023 173/4
2007/0290021 A1 * 12/2007 Komazaki ..... B25C 1/044 227/130
2008/0006425 A1 * 1/2008 Berghauser ..... B25D 17/24 173/201
2008/0006670 A1 * 1/2008 Wen ..... B25C 1/045 227/130
2014/0158740 A1 * 6/2014 Akutsu ..... B25C 1/044 227/130

FOREIGN PATENT DOCUMENTS

JP 2008213108 A * 9/2008
JP 4507384 B2 7/2010

* cited by examiner

*Primary Examiner* — Thanh K Truong
*Assistant Examiner* — Katie L Gerth
(74) *Attorney, Agent, or Firm* — Oliff PLC

(57) ABSTRACT

A driving tool is provided with first and second grease reservoirs for supplying grease to seal rings present on the outer and inner peripheral circumferences of a head valve in contact with a spring guide. Because of this configuration, wearing off of resistance of the seal rings due to gradual loss of grease can be improved and air leakage therefrom can also be prevented, which can improve durability of the driving tool.

16 Claims, 7 Drawing Sheets

DRIVING TOOL

CROSS-REFERENCE

This application claims priority to Japanese patent application serial number 2017-139949, filed on Jul. 19, 2017, wherein the contents of said application are incorporated herein by reference in their entirety.

TECHNICAL FIELD

The present invention generally relates to a driving tool such as, for example, a nail driver that is driven by compressed air.

BACKGROUND ART

Some types of driving tools developed in the art comprise a housing, a cylinder that is housed in said housing, a striking piston that moves in a reciprocating manner within the cylinder, and a head valve that opens/closes an upper chamber of the piston with respect to an accumulator. The head valve is situated so as to be located on both the outer circumference of the cylinder as well as the inner circumference of the housing so as to reciprocate in a direction in which the cylinder extends. Furthermore, the head valve is spring-biased by a compression spring that is interposed between a spring guide fixed to the outer circumference of the cylinder and the head valve, in a direction in which the upper chamber of the piston is closed with respect to the accumulator.

A variable pressure chamber and an exhaust chamber are also situated so as to be located on both the outer circumference of the cylinder as well as the inner circumference of the housing. The variable pressure chamber is configured to be in a state where it is opened to the atmosphere so as to apply the pressure of the atmosphere to a pressure-receiving surface of the head valve, or alternately in a state where it supplies compressed air so as to apply the air pressure of the accumulator to the pressure-receiving surface of the head valve. This changeover in state of the variable pressure chamber is performed by an on/off operation of a trigger valve operated by a user via their fingertip. The exhaust chamber is an area to which compressed air discharged from an upper chamber of the piston flows, where said flow is caused by a displacement of the head valve to the closing side after a driving operation. The compressed air flowing to the exhaust chamber is discharged to the outside via an exhaust hole provided on the housing.

In order to open and close the head valve in a smooth manner as well as to prevent exhaust leakage, the variable pressure chamber and the exhaust chamber are required to be separated in a sealed manner with respect to each other at all times. In order to separate the variable pressure chamber from the exhaust chamber, for example, a seal member such as an O-ring is respectively provided on an outer circumferential surface of the head valve facing the housing as well as on an inner circumferential surface of the head valve facing the cylinder. Generally, grease (lubricant) is applied to the seal member in order to provide airtightness as well as sliding ability. However, high-speed reciprocation of the head valve by compressed air in a driving operation may cause the applied grease to gradually decrease, and hence the wearing resistance of the seal member is greatly reduced, where eventually malfunction of the driving tool may occur.

The variable pressure chamber and the exhaust chamber are narrow portions having relatively small volume and are structurally formed in a dead end manner. Because of this structural configuration, there has existed a problem wherein sufficient grease is not easily applied to the seal member that separates the two chambers in a manufacturing process of the driving tool. One solution has been to contain mist-like lubricant in compressed air to apply lubricant to each part of the driving tool in a maintenance process. However, in this case, it has been difficult to apply sufficient mist-like lubricant to the seal member that separates the variable pressure chamber from the exhaust chamber.

Japanese Patent No. 4507384 discloses a driving tool in which mist-like grease contained in exhaust air from the cylinder is allowed to return to around the seal member. However, in the configuration in which air that contains grease is circulated, which is disclosed, for example, in Japanese Patent No. 4507384, the amount of grease unavoidably decreases compared with that at product shipment and thus replenishment of grease may be required. In contrast, if the driving tool is provided with a grease supplying source from which sufficient grease can be supplied to the seal member disposed on the outer and inner circumferential surfaces of the head valve, a user can save time to replenish grease.

Thus, as a result of the mentioned deficiencies in the art, there is a need in the art to sufficiently lubricate the seal member provided between the head valve and the housing as well as between the head valve and the cylinder in order to improve wear resistance of the seal member and ultimately to improve durability of the driving tool.

SUMMARY

In one exemplary embodiment of the present disclosure, a driving tool comprises a housing, a cylinder that is housed in the housing, a head valve that is situated to be disposed on both an outer peripheral circumference of the cylinder as well as on an inner peripheral circumference of the housing so as to move in a reciprocating manner in a longitudinal direction in which the cylinder extends, and a spring guide that is situated so as to be located on both the outer peripheral circumference of the cylinder as well as on the inner peripheral circumference of the housing so as to be brought into contact with an end portion of the head valve via an elastic member that is disposed vertically between the head valve and the spring guide. Furthermore, the head valve is provided with a seal member between the housing and the head vale and between the cylinder and the head valve, at its radially outer and inner edges, respectively. Furthermore, the spring guide is provided with a grease reservoir on a contact portion with the head valve.

According to this embodiment, grease can be supplied to the seal members provided on the head valve from the contact portion of the head valve with the spring guide through the outer and inner circumferences of the head valve. Because of this configuration, wearing off of resistance of the seal members respectively provided between the head valve and the housing and between the head valve and the cylinder due to gradual loss of grease can be improved to cause air leakage to be prevented, which can improve durability of the driving tool.

In another exemplary embodiment of the disclosure, the spring guide is provided with a first grease reservoir on an outer circumference thereof and a second grease reservoir on an inner circumference thereof as the grease reservoir.

According to this embodiment, the first grease reservoir is disposed in a vicinity of the outer peripheral circumference of the head valve and the second grease reservoir is disposed in a vicinity of the inner peripheral circumference of the head valve. Because of this configuration, collectively, the grease reservoirs serve as a grease supply source to the seal members, which can be provided such that thickness of the spring guide does not need to be largely reduced in the radial direction thereof.

In another exemplary embodiment of the disclosure, the spring guide is provided with a spring holding portion for holding the elastic member. Furthermore, the head valve is biased in an upward direction to be vertically spaced apart from the spring guide by said elastic member disposed between the head valve and the spring holding portion. Furthermore, the grease reservoir and the spring holding portion are disposed alternately in a circumferential direction of the spring guide.

According to this embodiment, the spring guide can be provided with the grease reservoirs as well as the spring holding portions in a manner such that strength of the spring guide may not be largely reduced.

In another exemplary embodiment of the disclosure, the head valve is provided with a third grease reservoir at an end portion of the head valve in contact with the spring guide on the outer circumference of the head valve.

According to this embodiment, grease supplied from the first grease reservoir can be temporarily stored in the third grease reservoir. Furthermore, grease stored in the third grease reservoir can be applied to the seal member disposed on the outer circumference of the head valve by the up-and-down movement caused by the opening/closing operations of the head valve.

In another exemplary embodiment of the disclosure, the driving tool further comprises a first recess that is provided on the inner circumference of the housing, and a scraping claw that is provided in the head valve. Furthermore, the first recess straddles the first grease reservoir as well as the third grease reservoir when the head valve is brought into contact with the spring guide. Furthermore, the scraping claw protrudes outwards in a radial direction of the head valve on a side facing the spring guide.

According to this embodiment, grease can be easily supplied from the first grease reservoir to the third grease reservoir through the first recess. Furthermore, grease stored in the first recess can be drawn to the third grease reservoir by the scraping claw when the head valve is returned to the initial position, where said claw can scrape grease upward from the first grease reservoir towards the third grease reservoir.

In another exemplary embodiment of the disclosure, the driving tool further comprises a second recess that is provided on the outer circumference of the cylinder so as to be radially adjacent to the second grease reservoir. Furthermore, the second recess is disposed so as to extend from a contact portion of the spring guide with the head valve toward a side of the head valve.

According to this embodiment, grease can be efficiently supplied to the seal member provided on the inner circumference of the head valve from the second grease reservoir through the second recess.

In another exemplary embodiment of the disclosure, the driving tool further comprises a third recess that is provided in the head valve so as to be adjacent to the second recess when the head valve is brought into contact with the spring guide.

According to this embodiment, grease supplied to the seal member provided on the inner circumference of the head valve can be stored in the third recess.

In another exemplary embodiment of the disclosure, the driving tool further comprises a variable pressure chamber that is provided in the housing for supplying air serving to return the head valve to an initial position, the variable pressure chamber being open with respect to fluid communication with the grease reservoirs.

According to this embodiment, grease in the grease reservoirs can be moved toward the initial position of the head valve (in the upward direction of the driving tool) by air flow for returning the head valve in the initial direction.

DETAILED DESCRIPTION

The detailed description set forth below, when considered with the appended drawings, is intended to be a description of exemplary embodiments of the present invention and is not intended to be restrictive and/or to represent the only embodiments in which the present invention can be practiced. The term "exemplary" used throughout this description means "serving as an example, instance, or illustration," and should not necessarily be construed as preferred or advantageous over other exemplary embodiments. The detailed description includes specific details for the purpose of providing a thorough understanding of the exemplary embodiments of the invention. It will be apparent to those skilled in the art that the exemplary embodiments of the invention may be practiced without these specific details. In some instances, these specific details refer to well-known structures, components and/of devices that are shown in block diagram form in order to avoid obscuring significant aspects of the exemplary embodiments presented herein.

Figure 1:
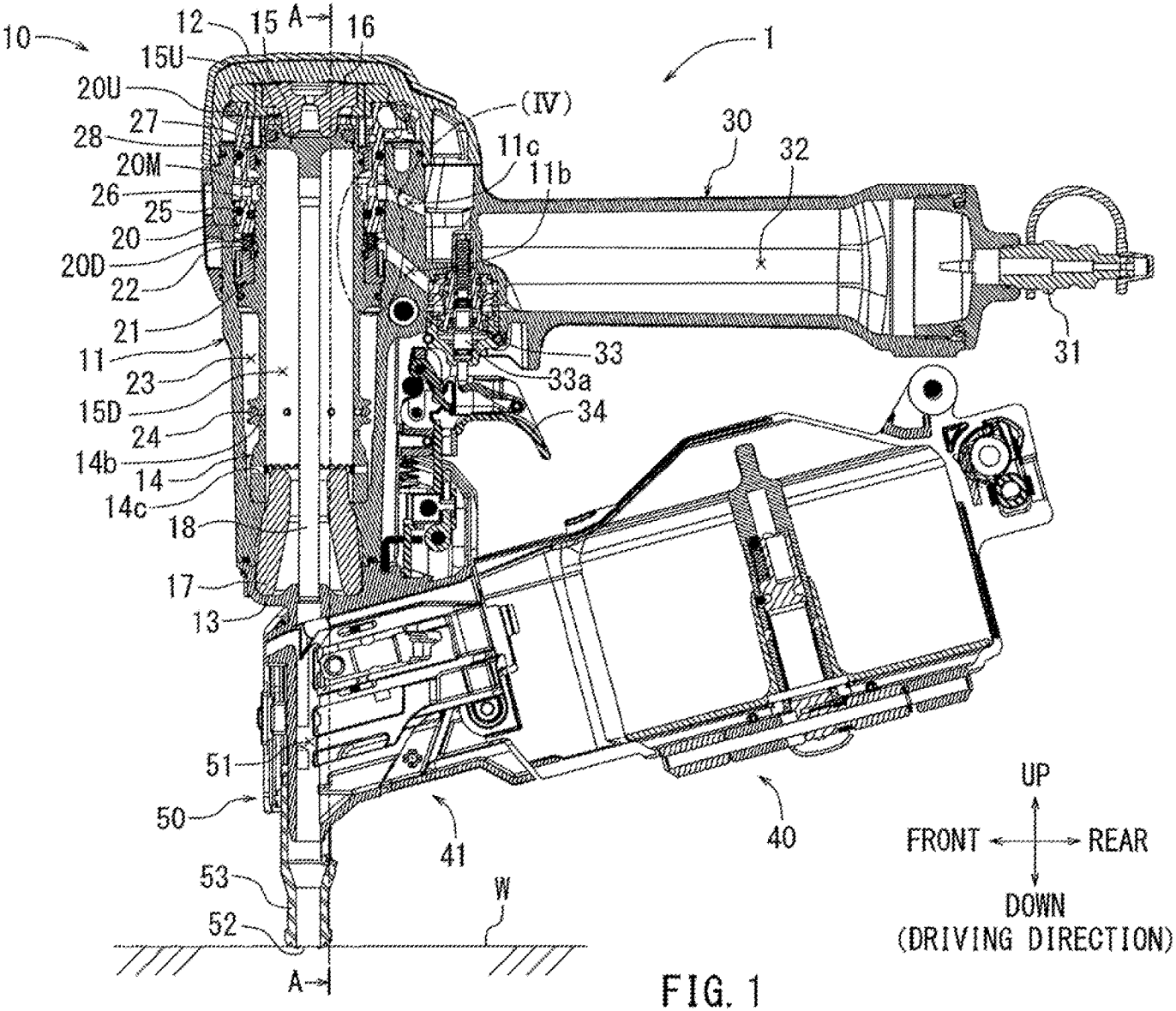
FIG. 1 is a longitudinal sectional view of a driving tool according to an exemplary embodiment of the present disclosure viewed from the left side thereof, showing the trigger valve in an off position and where the head valve as well as the piston is located at an initial position (upper stroke end).
Figure 2:
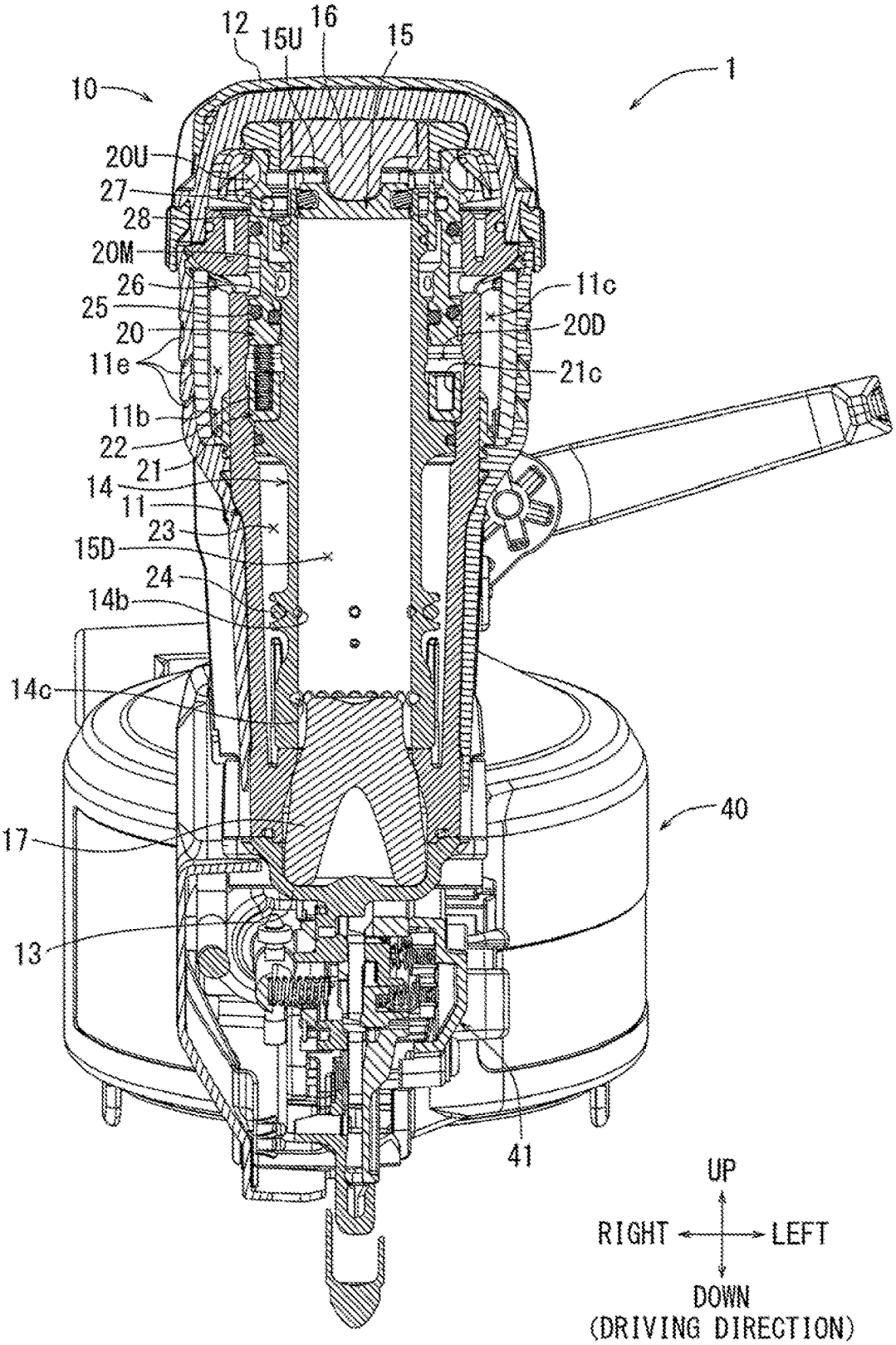
FIG. 2 is a cross-sectional view taken along line A-A of FIG. 1, showing a longitudinal sectional view of the driving tool according to the exemplary embodiment viewed from the front side thereof.

Representative, non-limiting embodiments according to the present disclosure will be described with reference to FIGS. 1 to 7. As shown in FIG. 1, the driving tool 1 according to the present embodiment is a nail driver that drives nails into a workpiece using compressed air as a driving force. In the following embodiments, with regard to the orientation of directions recited as up and down, the driving direction of driven members from the tool towards a workpiece is referred to as the downward direction. Furthermore, the leftward and rightward directions are described relative to a user's position, where in the figures the user is holding the device from its rear, with left and right as indicated in FIG. 2. The driving tool 1 may be provided with a tool main body 10, a grip 30 extending from a lateral portion of the tool main body 10 in the rearward direction, a magazine 40 that can load a plurality of members to be driven, and a driving nose 50 extending from a lower portion of the tool main body 10 in the downward direction.

As shown in FIG. 1, the tool main body 10 may be provided with a tubular housing 11 extending in the up-to-down direction. A top portion of the housing 11 may be covered by a top cap 12 in a sealed manner. A lower portion of the housing 11 may be covered by a front cap 13 in a sealed manner. A cylinder 14 may be housed in the interior of the housing 11 extending in the up-to-down direction. A piston 15 may be provided within the interior of the cylinder 14 so as to move in a reciprocating manner in a longitudinal direction in which the cylinder 14 extends (the up-to-down direction). The piston 15 may reciprocate between an upper end damper 16 provided on the lower surface of the top cap 12 and a lower end damper 17 provided on the upper surface of the front cap 13. In the process of reciprocating, the piston 15 comes into contact with the inner peripheral wall of the cylinder 14 in a sealed manner. Because of this adjacent, touching configuration, the piston 15 may form a seal and block airflow in the cylinder between a piston upper chamber 15U above the piston 15 and a piston lower chamber 15D below the piston 15. A driver 18 used for driving a member to be driven may be attached to the center of the piston 15 on its lower surface side. The driver 18 may be formed as a vertical bar shape extending in the longitudinal up-to-down direction in which the cylinder 14 extends. The driver 18 may reciprocate in the longitudinal up-to-down direction in a collective manner, moving jointly with the piston 15. When the driver 18 moves in the downward direction, the lower end portion of the driver 18 moves in the downward direction within a driving passage 51 that will be discussed infra.

Figure 3:
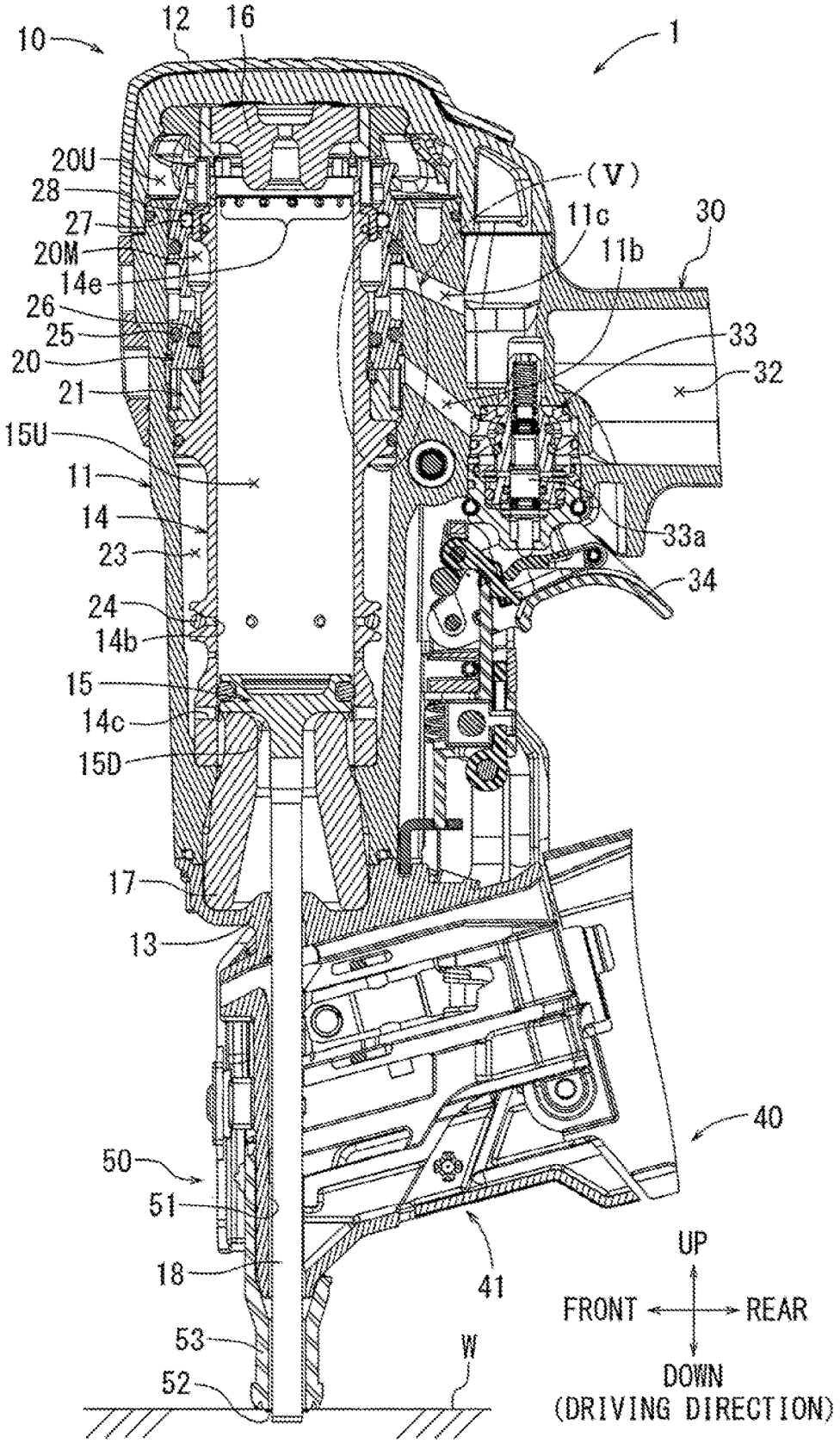
FIG. 3 is a longitudinal sectional view of the driving tool according to the exemplary embodiment viewed from the left side thereof, showing the trigger valve in an on position and where the head valve as well as the piston is located at a shooting position (lower stroke end).
Figure 4:
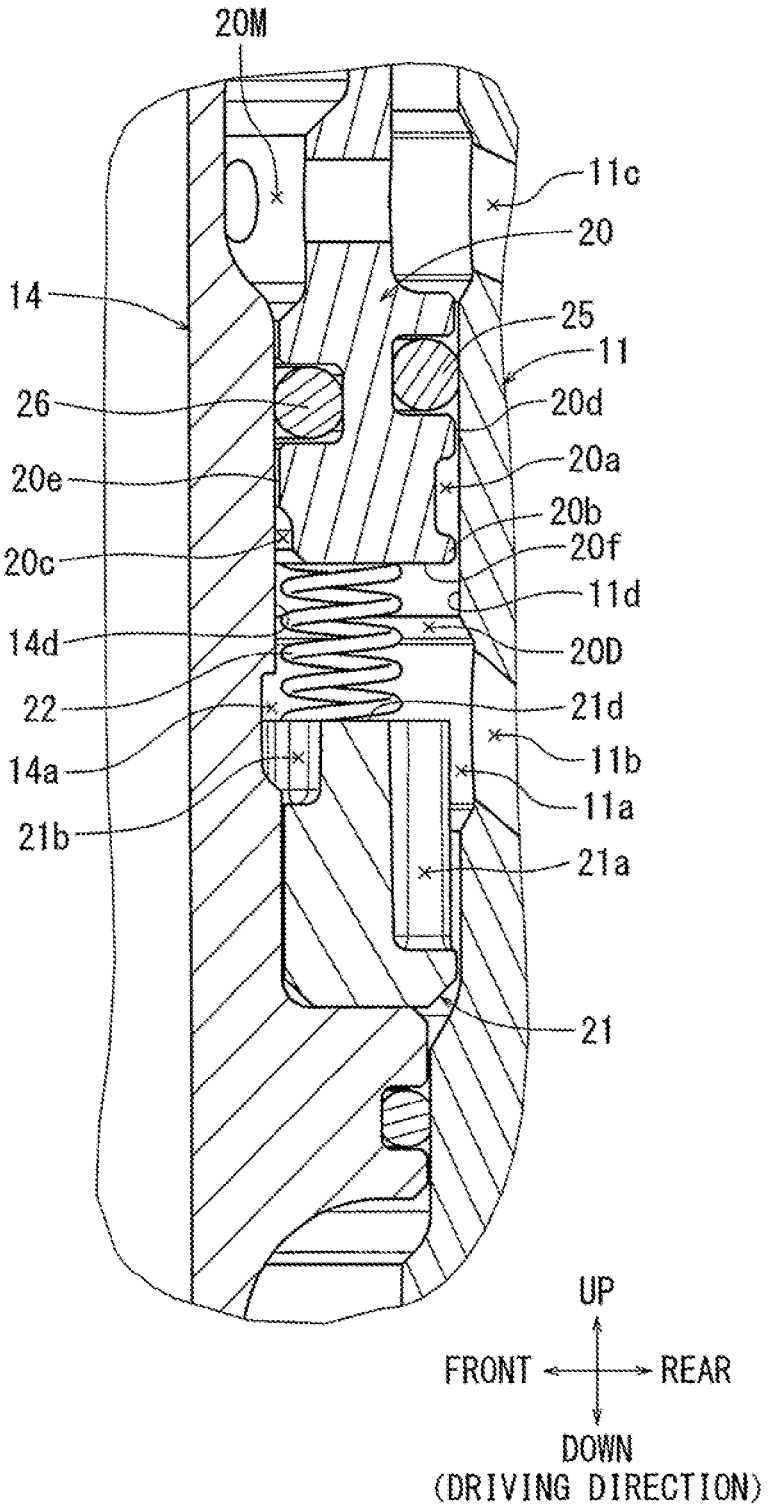
FIG. 4 is an enlarged view of (IV) in FIG. 1, showing a longitudinal sectional view of a lower chamber of the head valve.
Figure 5:
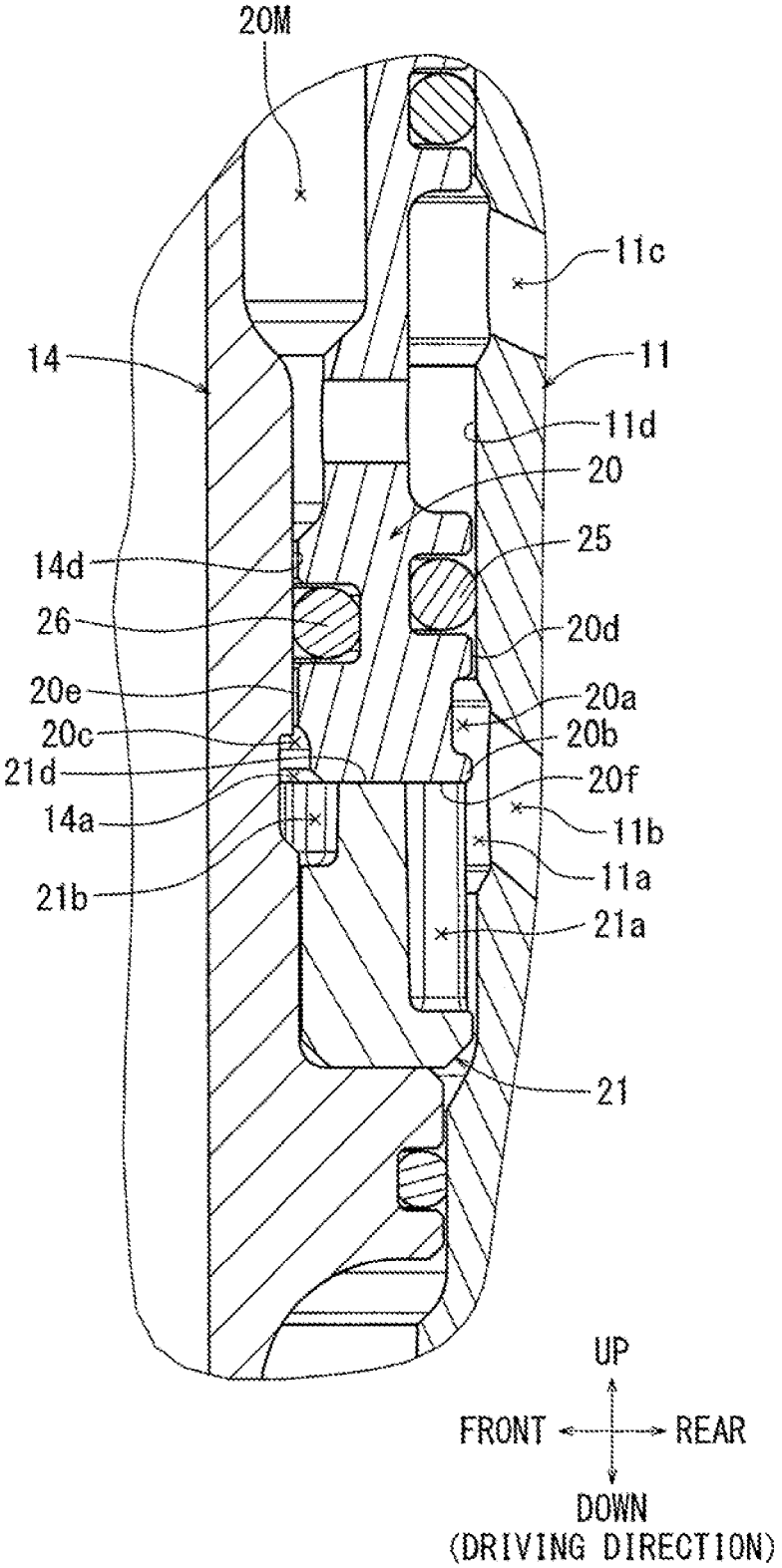
FIG. 5 is an enlarged view of (V) in FIG. 3, showing a longitudinal sectional view of the lower chamber of the head valve.

As shown in FIG. 1, a head valve 20 formed approximately in a tubular shape may be situated so as to be located on both the upper portion of the inner peripheral circumference of the housing 11 as well as on the upper portion of the outer peripheral circumference of the cylinder 14. The head valve 20 may be provided so as to reciprocate in the longitudinal direction in which the cylinder 14 extends (in the up-to-down direction). A head valve upper chamber 20U into which compressed air flows may be provided above the head valve 20. Additionally, a variable pressure chamber 20D may be provided below the head valve 20. As shown in FIGS. 4 and 5, the outer peripheral circumferential surface 20*d* of the head valve 20 may move with respect to the adjacent inner peripheral circumferential surface 11*d* of the housing 11 in the longitudinal up-to-down direction. When such movement occurs, concomitantly, at the opposite radial side of the head valve 20, the inner peripheral circumferential surface 20*e* of the head valve 20 moves with respect to the adjacent outer peripheral circumferential surface 14*d* of the cylinder 14 in the up-to-down direction. Furthermore, a seal ring 25 may be provided within the outer radial portion head valve 20 such that its outermost radial end is approximately collinear with the outer peripheral circumferential surface 20*d* in the up-to-down direction, and touches the inner peripheral circumferential surface 11*d*. Similarly a seal ring 26 may be provided within the inner radial portion of head valve 20 such that its innermost radial end may be approximately collinear with the inner peripheral circumferential surface 20*e* in the up-to-down direction, and touches the outer peripheral on the inner circumferential surface 20*e* thereof. As a result of the fight contact formed by the seal rings, an air-tight barrier between the variable pressure chamber 20D and an exhaust passage 20M that is discussed infra may be maintained by the seal rings 25 and 26. As shown in FIGS. 1 and 2, when the head valve 20 is disposed at the upper moving end, the head valve upper chamber 20U may be closed with respect to the piston upper chamber 15U by the head valve 20. Conversely, as shown in FIG. 3, when the head valve 20 moves in the downward direction, the head valve upper chamber 20U may be open with respect to the piston upper chamber 15U.

Figure 7:
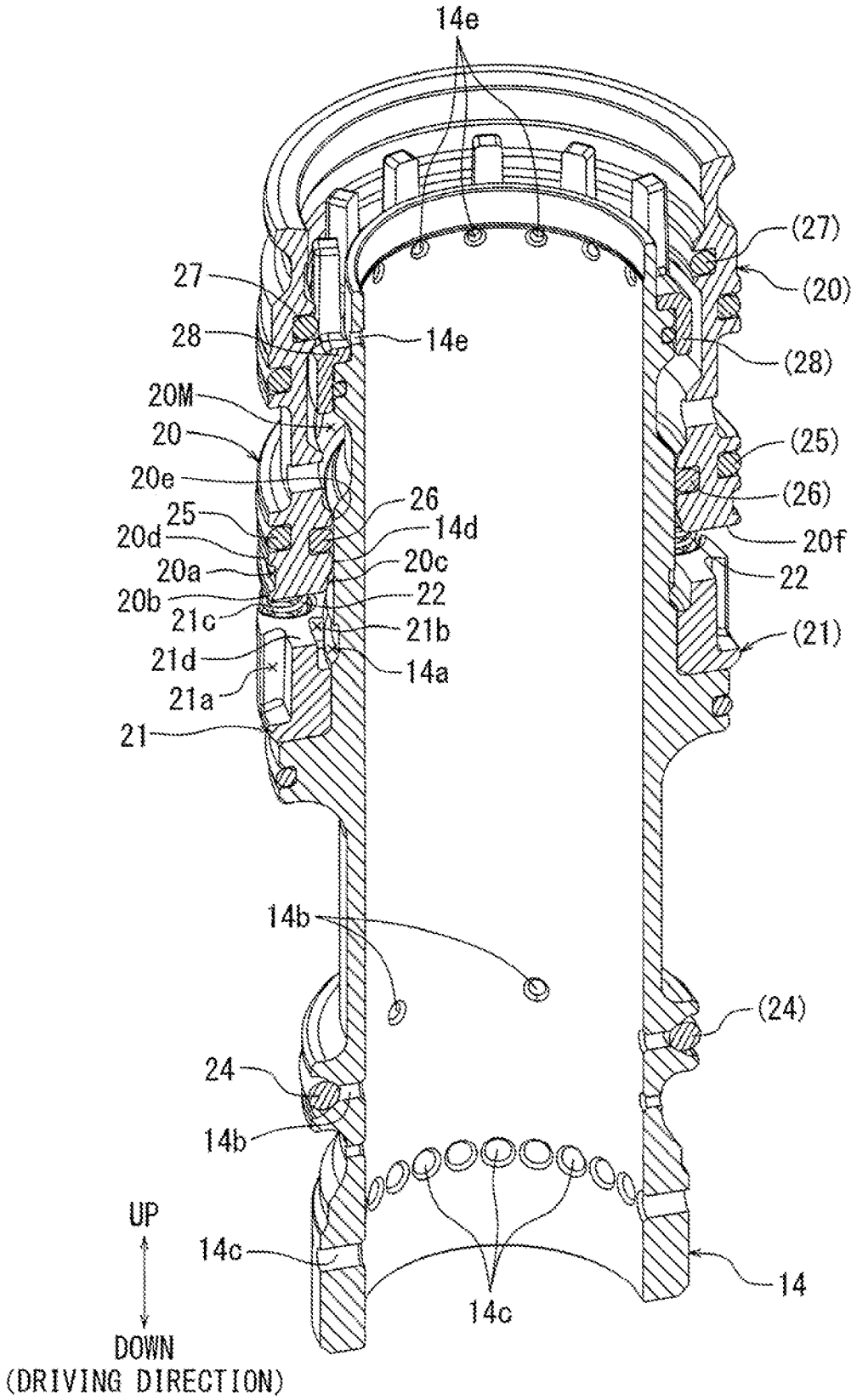
FIG. 7 is a half-split perspective view of the cylinder shown in FIG. 6 with a seal ring as well as a compression spring being attached.

A spring guide 21 composed of resin, formed approximately in a tubular shape, is situated so as to be located below the head valve 20 adjacent to and in contact with both the upper portion of the inner peripheral circumference of the housing 11 as well as on the upper portion of the outer peripheral circumference of the cylinder 14, as shown in FIG. 1. The variable pressure chamber 20D may be disposed vertically between the head valve 20 and the spring guide 21. As shown in FIG. 7, a spring holding portion 21*c* that holds the compression spring 22 may be provided as part of the spring guide 21. The compression spring 22 may be disposed vertically between the lower end surface 20*f* of the head valve 20 and the spring holding portion 21*c*, extending downward into the interior of the spring guide 21. The head valve 20 may be biased by the compression spring 22 in the upwards direction so as to be pushed away from the spring guide 21 (in the upward direction), which is the closing direction of the head valve 20. Conversely, when the head valve 20 moves toward the spring guide 21 (in the downward direction) against the biasing force of the compression spring 22, it is moving in the opening direction of the head valve 20. When moving in said direction, against the biasing force of the compression spring, the lower end surface 20*f* of the head valve 20 may be brought into contact with the upper end surface 21*d* of the spring guide 21, as shown in FIG. 5. When the spring is compressed in this manner, a lower moving end of the head valve 20 may be held in position by the upper end surface 21*d* of the spring guide 21.

As shown in FIG. 1, an airflow passage 11*b* may be provided in the housing 11 so as to penetrate through the housing 11 approximately in a radial direction and vertically downward direction (from the inner peripheral circumference of the housing 11 to the outer peripheral circumference of the housing at its upper portion, adjacent to the head valve 20). An inner peripheral circumferential side opening of the airflow passage 11*b* at its radial inner end may be in fluid communication with an area vertically between the head valve 20 and the spring guide 21 (the variable pressure chamber 20D) in the up-to-down direction. An outer peripheral circumferential side opening of the airflow passage 11*b* at its radial outer end may be in fluid communication with a trigger valve 33 that is discussed infra.

An exhaust passage 20M may be provided approximately in the middle of the head valve upper chamber 20U and the variable pressure chamber 20D, vertically in between the two. The exhaust passage 20M may be in fluid communication with a housing exhaust passage 11*c* that penetrates through the housing 11 approximately in the radial and vertically downward directions (from the inner peripheral circumference of the housing 11 to the outer peripheral circumference of the housing at its upper portion, adjacent to the head valve 20), above the airflow passage 11*b* As shown in FIG. 2, the housing exhaust passage 11*c* may be in fluid communication with the atmosphere via exhaust holes 11*e* of the exhaust cover (a component number is not assigned to the exhaust cover). Because of this configuration of these holes, which are spaced circumferentially around the exhaust cover, the exhaust passage 20M as well as the housing exhaust passage 11*c* are both open to the atmosphere at all times.

Figure 6:
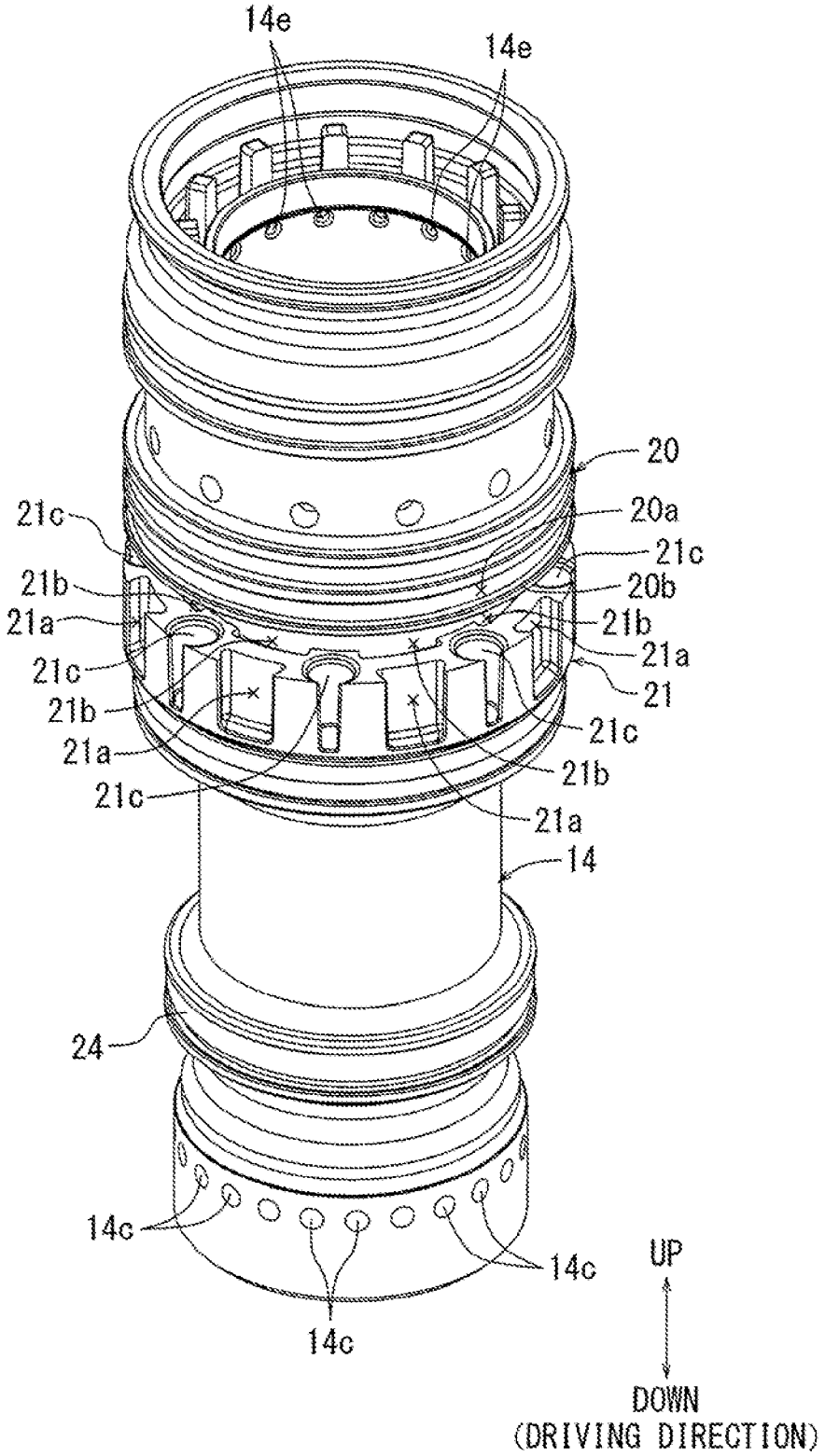
FIG. 6 is a perspective view of a cylinder of the driving tool according to the exemplary embodiment, to which the head valve as well as a spring guide is attached.

As shown in FIGS. 4 to 7, a plurality of first grease reservoirs 21*a* formed in a dovetail groove shape, extending from the upper end surface 21*d* of the spring guide 21 in the downward direction, may be provided on the upper portion of the outer peripheral circumference of the spring guide 21. The first grease reservoirs 21*a* may be provided at equally spaced apart intervals in the circumferential direction on the outer peripheral circumference of the spring guide 21. Furthermore, a plurality of second grease reservoirs 21*b* formed in a groove shape parallel to the first grease reservoirs 21*a*, which extend from the upper end surface 21*d* of the spring guide 21 in the downward direction, may be provided on the inner circumference of the spring guide 21. The number of the second grease reservoirs 21*b* may be equal to that of the first grease reservoirs 21. The second grease reservoirs 21*b* may be provided at equally spaced apart intervals in the circumferential direction on the inner peripheral circumference of the spring guide 21 so as to be positioned side by side, spaced apart from the first grease reservoirs 21*a* in the radial direction. The first grease reservoirs 21*a* may be deeper in terms of groove depth (in the radial direction of the spring guide 21) as well as longer in groove length (in the up-to-down direction) than the second grease reservoirs 21*b*. The spring holding portions 21*c* may also be provided at equally spaced apart intervals in the circumferential direction of the spring guide 21, and the number of spring holding portions 21*c* may be equal to the number of respective first grease reservoirs 21*a* (and consequently the number of the second grease reservoirs 21*b*, which is equal to the number of first grease reservoirs 21*a* as described above). The spring holding portions 21*c* may be positioned in uniform intervals which alternate with the intervals of the first grease reservoirs 21*a* (and the second grease reservoirs 21*b*) around the circumference of the spring guide 21, as shown in FIG. 6. As discussed above, the first grease reservoirs 21*a* are deeper in depth than the second grease reservoirs 21*b*, and may be formed in a dovetail groove shape such that the opening side thereof is narrower than the bottom side thereof (e.g. where for the first grease reservoir 2I a shown in FIG. 4, the width of the groove in the circumferential direction is smaller at the radial outermost end of the groove, versus the radial innermost end of the groove, where the circumferential width is larger, as seen in FIG. 6). Because of this dovetail configuration, grease retained in the first grease reservoirs 21*a* is prevented from easily leaking to the outside.

As shown in FIGS. 4 to 7, a third grease reservoir 20*a* that is a circumferential groove formed by a radially inward indentation on the lower portion of the outer peripheral circumference of the head valve 20. Furthermore, an annular scraping claw 20*b* that is formed by a radially outward protrusion below the inward indentation of the third grease reservoir 20*a* may be located immediately below the third grease reservoir 20*a*, on the lower portion of the outer peripheral circumference of the head valve 20. A lower basal end of the scraping claw 20*b* may be coplanar with the lower end surface 20*f* of the head valve 20 in the front-to-rear and circumferential directions. Furthermore, the scraping claw 20*b* may have a protruding length outward from the radially inward indentation of third grease reservoir 20*a* so as to be approximately vertically aligned in the up-to-down direction with the radially outermost circumference of the head valve 20 of its outer peripheral surface. A third recess 20*c* formed by a radially outward indented groove from the inner peripheral circumference of the head valve 20 in the circumferential direction is provided at the lower end surface 20*f* of the head valve 2. The third recess 20*c* may be provided such that when the head valve 20 moves to its lower movable end, against the biasing force of spring 22, to contact the spring guide 21, then in such a position the third recess 20*c* is disposed to be adjacent to the second grease reservoir 21*b*, as seen in FIG. 5.

As shown in FIGS. 4 and 5, a first recess 11*a* formed in a recessed shape extending radially outward may be provided on the inner circumference 11*d* of the housing 11 so as to be disposed adjacent to the first grease reservoir 21*a*. When the head valve 20 moves to its lower moving end to contact the spring guide 21 as described above, then at that time the first recess 11*a* may be disposed to be adjacent to the third grease reservoir 20*a*, as shown in FIG. 5. Furthermore, a second recess 14*a* formed in a recessed shape extending radially inward may be provided on the outer circumference 14*d* of the cylinder 14 so as to be disposed adjacent to the second grease reservoir 21*b*. When the head valve 20 moves to its lower moving end to contact the spring guide 21 as described above, then at that time the second recess 14*a* may be disposed to be adjacent to the third recess 20*c*, as shown in FIG. 5.

Sufficient grease, to fill the grease reservoirs, may be previously applied to the first grease reservoir 21*a*, the second grease reservoir 21*b*, the third grease reservoir 21*c*, the first recess 11*a*, the second recess 14*a*, and the third recess 20*c*, respectively, before the device is used.

As shown in FIGS. 1 and 3, a seal ring 27 may be provided within the upper region of head valve 20 so as to be positioned between the head valve upper chamber 20U and the exhaust passage 20M in the up-to-down direction, such that the innermost radial end of the seal ring 27 is approximately collinear with the upper region of head valve 20 immediately below the head valve upper chamber 20U in the up-to-down direction, and touches the inner peripheral surface of seal member 28 when head valve 20 is disposed at its lower moving end, as shown in FIG. 3. When the head valve 20 is disposed at its upper moving end, which is referred to as its initial position, as shown in FIG. 1, the seal ring 27 may be spaced apart from the seal member 28 that is provided on the upper outer circumference of the cylinder 14, in the up-to-down direction, as shown in FIG. 2. In this case, when the head valve 20 is at its initial position, the seal member 28 may not function as a seal member, and thus in this position the piston upper chamber 15U may be in fluid communication with the exhaust passage 20M. In other words, when the head valve 20 is disposed at its initial position, due to said fluid communication, pressure equalization occurs, and the air pressure in the piston upper chamber 15U may be equal to the pressure of the atmosphere. In contrast, when the head valve 20 moves out of its initial position to the position where it is at its lower moving end, the seal ring 27 may contact the seal member 28 as shown in FIG. 3, wherein the formation of said seal causes the piston upper chamber 15U to be blocked from fluidly communicating with the exhaust passage 20M. In other words, when the head valve 20 moves to its lower moving end, the piston upper chamber 15U may be isolated from the atmospheric pressure.

As shown in FIG. 1, a return air chamber 23 may be provided below the spring guide 21 located such that it is situated between the inner peripheral circumference of the housing 11 and the outer peripheral circumference of the cylinder 14. The housing 11 may come into contact with the cylinder 14 in a manner so as to form a seal at the upper end portion of the return air chamber 23, such that the housing 11 is blocked from the cylinder 14 so as to prevent the inflow/outflow of air. A plurality of valve holes 14*b* that penetrate through the radial thickness of the cylinder 14 may be provided spaced apart at equal intervals in the circumferential direction of the cylinder 14 above the lower moving end of the piston 15 in the return air chamber 23. Furthermore, an O-ring 24 may be mounted radially into a circumferential U-shaped groove formed as part of the cylinder 14 at approximately the same height as the valve holes 14*b*, where the valve holes 14*b* penetrate through the U-shaped groove, and the O-ring covers the radially inward of opening of said hole, to form a check-valve, as shown in FIG. 2. In this configuration, the O-ring 24 may cover an opening of each valve hole 14*b* on the outer circumferential side of the cylinder 14. Owing to the check valves formed by the O-ring 24, with sufficient force, compressed air may dislodge the O-ring 24 from covering the valve hole, and thus the air may flow from the inner circumference of the cylinder 14 to the outer circumference thereof via the valve holes against the biasing-force of the O-ring 24. However, air may not flow from the outer circumference to the inner circumference of cylinder 14, since the O-ring 24 is biased radially inward, against the center of the U-shape, and hence air flowing in this direction cannot prevent the O-ring from blocking the valve hole. Furthermore, a plurality of return holes 14*c* that penetrate through the radial thickness of the cylinder 14 may be provided spaced apart at equal intervals in the circumferential direction of the cylinder 14 below the lower moving end of the piston 15, at the lower end of the return air chamber 23.

As shown in FIG. 1, the grip 30 may have an approximately tubular shape extending in the front-to-rear direction, where its outer peripheral surface may be provided in such a manner that user can firmly hold the grip 30 with their hand. An air plug 31 for connecting an air hose (not shown) via which compressed air may be supplied is provided at a rear end of the grip 30. Furthermore, an accumulator region 32 for accumulating compressed air that is supplied via the air hose may be provided in the interior of the grip 30. This region is configured such that compressed air gathered in the accumulator 32 may flow to the head valve upper chamber 20U at all times (not shown). Having flowed to the head valve upper chamber 20U, compressed air in said chamber may act to move the head valve 20 downward.

As shown in FIGS. 1 and 3, a trigger valve 33 may be provided at a basal portion of the grip 30, toward the grip's frontal portion at the lower end of its outer peripheral circumference. The airflow passage 11*b* may be provided between the trigger valve 33 and the variable pressure chamber 20D adjacent to the right side of the outer peripheral circumference of the housing 11, referring to FIG. 2. Furthermore, another airflow passage configured to be connected to the housing exhaust passage 11*c* may be provided above the trigger valve 33, wherein the exhaust passage 11*c* is adjacent to the left side of the outer peripheral circumference of the housing 11, referring to FIG. 2. The trigger valve 33 may also be connected to the accumulator 32 and thus compressed air from the accumulator 32 may flow to the trigger valve 33 at all times. A valve stem 33*a* of the trigger valve 33 may be provided so as to be movable between an off-position and an on-position. A trigger 34 that can be pulled by a fingertip of a user with the grip 30 being held by the user's hand may be provided below the trigger valve 33. When the trigger 34 is not pulled upward by the user, the valve stem 33*a* may be in the off-position as shown in FIG. 1. In contrast, when the trigger 34 is pulled while a contact arm 53, which will be discussed infra, is moved in the upward direction, the valve stem 33*a* may be moved into the on-position as shown in FIG. 3. When the user ceases to pull the trigger 34 upwards, and it is released, then the valve stem 33*a* may return to the off-position as shown in FIG. 1.

When the valve stem 33*a* is disposed in the off-position, as shown in FIG. 1, the lower end of the airflow passage 11*b* may be in fluid communication with the accumulator 32 via the trigger valve 33. Furthermore, when the valve stem 33*a* is disposed in the off-position, the airflow passage 11*b* may be blocked from the housing exhaust passage 11*c* by the trigger valve 33. Because this configuration, when the valve stem 33*a* is disposed in the off-position, compressed air from the accumulator 32 may flow to the variable pressure chamber 20D. Compressed air entering into the variable pressure chamber 20D may act to move the head valve 20 in the upward direction. However, when the valve stem 33*a* is moved into the on-position, as shown in FIG. 3, the airflow passage 11*b* may be in fluid communication with the housing exhaust passage 11*c*. Because of this configuration, when the valve stem 33*a* is disposed in the on-position, the variable pressure chamber 20D may be open to atmospheric pressure.

As shown in FIG. 1, the magazine 40 may be provided to extend rearward from the driving nose 50, which is discussed infra, toward the rear end portion of the grip 30. The magazine 40 may load aggregated members to be driven that are wound in a coil-shaped manner. The aggregated members to be driven may be aggregated such that a plurality of members to be driven are temporarily combined in parallel to each other at predetermined spaced apart intervals along the coil. In the figures, the aggregated members to be driven are omitted. A feed mechanism 41 may be provided at the front portion of the magazine 40. A front terminal end member of the loaded aggregated members to be driven may engage with the feed mechanism 41. After said engagement, the aggregated members to be driven may subsequently be pitch-fed to the driving passage 51 that will be discussed infra by the feed mechanism 41, wherein said members are reciprocated in a feeding direction while interlocking with the driving operation of the tool main body 10. By use of this pitch feed mechanism, the members to be driven can be consecutively supplied from the magazine to the driving passage 51, one-by-one.

As shown in FIG. 1, the driving nose 50 may be provided with the driving passage 51, an injection port 52, and a contact arm 53 that is brought into contact with a workpiece material W that the member to be driven is driven into. The driver 18, affixed to the piston 15 may move within the driving passage 51 in the downward direction by the driving operation of the tool main body 10. Furthermore, the members to be driven may be supplied to the interior of the driving passage 51 consecutively, one-by-one in an interlocking synchronous manner with the driving operation of the tool main body 10. In particular, when one such member that has been supplied to the interior of the driving passage 51, it may be driven out of the passage via the injection port 52 by the driver 18 moving in the downward direction. The contact arm 53 may be provided so as to slide along the driving passage 51 to conform with the fit of the tool main body 10 against the workpiece W. In particular, the contact arm 53 may slide in the upward direction by downward contact of the injection port 52 of the driving tool 1, with the top surface of the workpiece W, as shown in FIG. 1. When the contact arm 53 moves in the upward direction, a pull operation of the trigger 34 may be effective as an on operation.

Next, movements of the aforementioned components relating to compressed air during one cycle of the driving operation of the driving tool 1 will be explained with reference to FIGS. 1 to 5. In an initial state, the arrangement of each component of the driving tool 1 may be shown in FIGS. 1 and 4. In said initial state, compressed air may be supplied from the accumulator 32 to both the head valve upper chamber 20U as well as the variable pressure chamber 20D. The pressure-receiving area of the variable pressure chamber 20D with respect to the head valve 20 may be configured to be larger than that of the head valve upper chamber 20U. Furthermore, the head valve 20 may be biased in the upward direction by the compression spring 22. In this way, the head valve 20 in the initial state may be biased in the upward direction by both the compressed air in the variable pressure chamber 20D, which pushes the head valve 20 upward as described above, and by the compression spring 22. As a result, the head valve 20 may be retained in a closed position (its upper moving end position). Since the head valve 20 is retained at said closed position, the piston upper chamber 15U in turn may be retained in the initial state in which it is closed with respect to the head valve upper chamber 20U and in turn the accumulator 32.

When both the contact arm 53 moves in the upward direction by contacting the driven material W and subsequently the trigger 34 is pulled (switched on), then at that point compressed air in the variable upper chamber 20D may be discharged to the atmosphere from the airflow passage 11*b* through the housing exhaust passage 11*c* and the exhaust holes 11*e*. Because of this airflow, the air pressure within the variable pressure chamber 20D may become equal to that of atmospheric pressure. Furthermore, since the biasing force in the downward direction caused by the compressed air in the head valve upper chamber 20U becomes larger than the biasing force in the upward direction caused by the compression spring 22, the head valve 20 may start to move in the downward direction. When the head valve 20 moves in the downward direction, the piston upper chamber 15U may in turn be open with respect to the head valve upper chamber 20U and in turn the accumulator 32. Furthermore, the seal ring 27 may be engaged with the seal member 28, and thus the piston upper chamber 15U may be closed with respect to the exhaust passage 20M. When the piston upper chamber 15U is open with respect to the head valve upper chamber 20U, the compressed air flowing into the head valve upper chamber 20U may flow in a substantial manner into the piston upper chamber 15U. The piston 15 may start to move in the downward direction by the compressed air flowing into the piston upper chamber 15U. The driver 18 may move within the interior of the driving passage 51 in the downward direction by this downward movement of the piston 15 due to the direction of compressed air flow. Furthermore, the driver 18 moving in the downward direction may drive one member to be driven, which has been previously supplied into the driving passage 51 from the feed mechanism 41 synchronous with the driving cycle, out of the injection port 52 and into the workpiece W. As shown in FIG. 3, the piston 15 may be brought into contact with the lower end damper 17 to stop.

When the piston 15 moves below the valve holes 14*b* in the downward direction immediately before it stops, the compressed air within the piston upper chamber 15U may flow into the return air chamber 23 through the valve holes 14*b* against the biasing force of the check valve described above comprising O-ring 24, such that the O-ring 24 is pushed radially outward, so as to be widened, allowing air to go from the piston upper chamber 15U. At this stage, since the head valve 20 moves in the downward direction and the piston upper chamber 15U is open with respect to the head valve upper chamber 20U, the compressed air may continue to flow into the piston upper chamber 15U through the head valve upper chamber 20U. Because of this airflow, part of the compressed air within the piston upper chamber 15U may move the piston 15 to contact the lower end damper 17, and the rest of the compressed air may flow into the return air chamber 23 through the check valve comprising O-ring 24 as described.

While the piston 15 moves in the downward direction, the head valve 20 may also move in the downward direction toward the spring guide 21. The grease applied to the seal rings 25 and 26 on the head valve 20 may gradually decrease owing to repeated up-to-down movements of the head valve 20 as use of the driving tool 1 increases. Owing to the up-to-down movements of the head valve 20, an amount of grease commensurate with the amount grease decreased by the repeated up-to-down movements may be supplied to the seal ring 25 on the outer circumferential side from the third grease reservoir 20*a* and also may be supplied to the seal ring 26 on the inner circumferential side from the third recess 20*c*. In particular, referring to FIG. 5, when the head valve 20 moves to its lower moving end, where it comes into contact with the spring guide 21, the third grease reservoir 20*a* provided on the head valve 20 may be disposed radially adjacent to the first grease reservoir 21*a* through the first recess 11*a*. Because of this movement of the head valve into the first recess 11*a*, grease may be replenished from the first grease reservoir 21*a* to the third grease reservoir 20*a* through the first recess 11*a* owing to viscosity of the grease. Furthermore, when the head valve 20 moves to its lower moving end to come into contact with the spring guide 21, the third recess 20*c* provided on the head valve 20 may be disposed radially adjacent to the second grease reservoir 21*b* through the second recess 14*a*. Because of this movement of the head valve into the second recess 14*a*, grease may be replenished from the second grease reservoir 21*b* to the third recess 20*c* through the second recess 14*a* owing to viscosity of the grease.

As shown in FIGS. 3 to 5, when a pull operation (on-operation) of the trigger 34 is released by the user, to return valve stem 33*a* of the trigger valve 33 to the off position after the piston 15 moves to its lower moving end after having driven one member to be driven out of the injection port 52 and into the workpiece W with the driver 18, the airflow passage 11*b* may be blocked from the atmosphere and communicating with the exhaust passage 11*c* by the trigger valve 33 in the initial position. Because of this movement, compressed air may be supplied from the accumulator 32 to the variable pressure chamber 20D through the airflow passage 11*b*. Since the compressed air flows to the variable pressure chamber 20D in which the air pressure was previously equal to the pressure of the atmosphere, grease accumulated in the first grease reservoir 21*a* and the second grease reservoir 21*b* may flow into the first recess 11*a* and the second recess 14*a* by upward directed direction of the air flow. Furthermore, the head valve 20 may also start to move in the upward direction by the biasing force caused by the air pressure due to the inflow of compressed air pushing in the upward direction in the variable pressure chamber 20D as well as due to the biasing force of the compression spring 22 in the upward direction.

When the head valve 20 moves in the upward direction, a portion of the grease in the first recess 11*a* may move and/or be scraped into the third grease reservoir 20*a* by the scraping claw 20*b*, as the radially outwardly indented claw 20*b* moves upward. When the head valve 20 moves further in the upward direction, grease accumulated in the third grease reservoir 20*a* and the third recess 20*c* may be moved and applied to the seal rings 25 and 26, respectively, in accordance with the upward movement of the head valve 20. When the head valve 20 moves further in the upward direction to reach to its initial position (the upper moving end) as shown in FIG. 1, the piston upper chamber 15U may be closed with respect to the head valve upper chamber 20U and thus in turn compressed air from the accumulator 32 and thus supply of compressed air to the piston upper chamber 15U is prevented from flowing in (shut off).

When the piston upper chamber 15U returns to such a state, where it is closed with respect to the head valve upper chamber 20U, as shown in FIG. 1, the seal ring 27 moves upward and is removed from radially adjacently contacting the seal member 28, and consequently the piston upper chamber 15U may enter a state where it is open with respect to the exhaust passage 20M. Because of this state, compressed air within the piston upper chamber 15U may be discharged to the atmosphere and thus the air pressure in the piston upper chamber 15U may be equal to e atmospheric pressure. In contrast, compressed air flowing into the return air chamber 23 may flow into the piston lower chamber 15D through the return holes 14*c*. Because of this airflow, the pressure in the piston lower chamber 1513 may become larger than that in the piston upper chamber 15U and thus the piston 15 may be pushed upward to its upper moving end in the upward direction to return to the initial state. Residual compressed air that flows into the piston lower chamber 15D through the return air chamber 23 may be discharged to the exhaust passage 20M through a cylinder exhaust passage 14*e* that is provided at an upper portion of the cylinder 14 as shown in FIG. 3. Because of this structural configuration of airflow, the pressure in the piston lower chamber 15D may eventually return to the atmospheric pressure. In this way, one cycle of the driving operation starting from the pull operation (on-operation) of the trigger 34 may be completed.

According to the driving tool 1 of the present embodiment discussed above, when the head valve 20 moves in the downward direction to come into contact with the spring guide 21, grease accumulated in the first grease reservoir 21*a* provided on the outer peripheral circumference of the upper end surface 21*d* of the spring guide 21 may be supplied to the third grease reservoir 20*a* provided on the lower portion of the outer circumference of the head valve 20, as described above. Grease that is supplied to the third grease reservoir 20*a* in this manner may be spread to the outer circumference 20*d* of the head valve 20 in accordance with the up-to-down movement of the head valve 20, and in an onward manner may then be supplied likewise to the seal ring 25. By supplying grease to the seal ring 25 provided on the outer circumference 20*d* of the head valve 20, excessive wear of the seal ring 25 due to decrease of grease can be prevented, which can help maintain air-tightness of the variable pressure chamber 20D with respect to the exhaust passage 20M, and can thus improve durability of the driving tool 1.

Furthermore, according to the driving tool 1 of the present embodiment, when the head valve 20 moves in the downward direction to come into contact with the spring guide 21, grease accumulated in the second grease reservoir 21*b* provided below the inner peripheral circumference of the upper end surface 21*d* of the spring guide 21 may be supplied to the third recess 20*c* provided on the inner peripheral circumference of the lower end surface 20*f* of the head valve 20, as described above. Grease that is supplied to the third recess 20*c* in this manner may be spread to the inner circumference 20*e* of the head valve 20 in accordance with the up-to-down movement of the head valve 20, and in an onward manner may then be supplied likewise to the seal ring 26. By supplying grease to the seal ring 26 provided on the inner circumference 20*e* of the head valve 20, excessive wear of the seal ring 26 due to decrease of grease can be prevented, which can help maintain air-tightness of the variable pressure chamber 20D with respect to the exhaust passage 20M, and can thus improve durability of the driving tool 1.

Furthermore, according to the driving tool 1 of the present embodiment, grease supply to the seal ring 25 on the outer peripheral circumference 20*d* of the head valve 20 may be carried out by the first grease reservoir 21*a*, and grease supply to the seal ring 26 on the inner peripheral circumference 20*e* of the head valve 20 may be carried out by the second grease reservoir 21*b*, respectively. Because of this configuration, grease can be supplied to the seal rings 25 and 26, respectively, in an up-to-down manner, without needing to increase (groove) length of the first grease reservoir 21*a* and the second grease reservoir 21*b* in the radial direction. Thus, in this way, the structural tensile strength of the spring guide 21 can be maintained while the thickness of the spring guide is not reduced in the radial direction.

Furthermore, according to the driving tool 1 of the present embodiment, the spring holding portion 21*c* may be disposed in an alternating manner with the first grease reservoir 21*a* and the second grease reservoir 21*b*, along the circumferential direction of the spring guide 21, as illustrated in FIG. 6. This alternating configuration prevents the need for having only a thin portion of the spring guide 21 in both the radial direction as well as in the circumferential direction, and in contrast, the alternating configuration by having alternating radial thicknesses can maintain strength of the spring guide 21. Furthermore, as shown in FIGS. 4 and 5, the groove length of the first grease reservoir 21*a* in the up-to-down direction may be configured to be larger than that of the second grease reservoir 21*b*. The reservoirs are sized in this manner due to the seal ring 25 on the outer circumference side wearing out applied grease more rapidly than the seal ring 26 on the inner circumference side, thus making it necessary to supply more grease to the seal ring 25 disposed on the outer circumference side in comparison with the seal ring 26 on the inner circumference side. Because of this configuration, sufficient thickness of the spring guide 21 can be obtained and thus its strength can be maintained.

Furthermore, according to the driving tool 1 of the present embodiment, when grease is supplied from the first grease reservoir 21*a* to the seal ring 25 on the outer peripheral circumference 20*d* of the head valve 20, the third grease reservoir 20*a* may temporarily serve as an intermediary holding portion, as described, when the grease moves upward. Because of this configuration, the third grease reservoir 20*a* is able to act as a buffer region, and non-uniformity of grease supply can be reduced and thus efficiency for supplying grease can be improved. Similarly, when grease is supplied from the second grease reservoir 21*b* to the seal ring 26 on the inner circumference 20*e* of the head valve 20, the third recess 20*c* may temporarily serve as another intermediary holding portion. Because of this configuration, the third recess 20*c* acts as a buffer, and non-uniformity of grease supply can be also reduced and thus efficiency for supplying grease can be further improved.

Furthermore, according to the driving tool 1 of the present embodiment, the first recess 11*a* may be provided on the inner peripheral circumference 11*d* of the housing 11 such that it straddles both the first grease reservoir 21*a* as well as the third grease reservoir 20*a* in the up-to-down direction, when the head valve 20 is disposed at its lower moving end. Because of this configuration, grease may be easily and efficiently supplied from the first grease reservoir 21*a* to the third grease reservoir 20*a* through the first recess 11*a* in an upward-moving manner. Furthermore, to enhance this process, grease accumulated in the first recess 11*a* can be more efficiently moved and/or drawn into the third grease reservoir 20*a* by the radially outward indented scraping claw 20*b* that is provided on the lower side of the third grease reservoir 20*a* and moves upward, also scraping the grease upward into the third grease reservoir 20*a*.

Furthermore, according to the driving tool 1 of the present embodiment, the second recess 14*a* may be provided on the outer peripheral circumference 14*d* of the cylinder 14 such that it straddles both the second grease reservoir 21*b* as well as the third recess 20*c* when the head valve 20 is disposed at its lower moving end. Because of this configuration, grease may be easily and efficiently supplied from the second grease reservoir 21*b* to the third recess 20*c* through the second recess 11*a* in an upward-moving manner.

Furthermore, according to the driving tool 1 of the present embodiment, the airflow passage 11*b* may be open with respect to each grease reservoir as well as each recess. Furthermore, the airflow passage 11*b* may be configured to extend from a lower end to an upper end when viewed traversing from the outer peripheral circumference of the housing 11 to the inner peripheral circumference thereof. When a pull operation (on-operation) of the trigger 34 is released by the user to supply compressed air in the accumulator 32 through the airflow passage 11*b* after having driven a member through 52 into the workpiece W, compressed air may flow to the variable pressure chamber 20D through the airflow passage 11*b*. In this way, compressed air may flow to the variable pressure chamber 20D where the pressure equalizes and becomes equal to atmospheric pressure. As a result, grease accumulated in each grease reservoir as well as each recess may be moved and/or drawn in a direction along the airflow passage 11*b*, i.e., in an upward manner toward the upper side of the head valve 20 by the flow of compressed air.

Furthermore, according to the driving tool 1 of the present embodiment, the first grease reservoir 21*a* may be formed in a dovetail groove shape, as shown in FIG. 6 and discussed above. Because of this configuration, the necessary radial thickness needed to fortify the spring guide 21 circumferentially between the first grease reservoir 21*a* and its adjacent spring holding portion 21*c* can be obtained. Furthermore, grease may be moved by a contact of the head valve 20 with the spring guide 21 at its lower moving end, as well as with air flow for returning to the initial position, as discussed above, but because of the presence of the dovetail groove shape configuration, where the circumferential thickness at the radially outermost end of the first grease reservoir 21*a* is smallest, more grease than necessary may be prevented from being moved and/or drawn from the first grease reservoir 21*a* as the grease moves upward from the radial outer end of the first grease reservoir 21*a*.

The present embodiment of the driving tool 1 discussed above may be further modified without departing from the scope and spirit of the present teachings. In the present embodiment, the driving tool 1 is exemplified in which the head valve 20 is disposed above the spring guide 21. However, the configuration in which the grease reservoirs and the recesses for storing grease as discussed in the driving tool 1 of the present embodiment can be applied to a driving tool in which the head valve is disposed below the spring guide and a lower moving end of the head valve is its initial position. Furthermore, the size, shape, and the number of the grease reservoirs and the recesses can be modified without limiting the present embodiment.

Furthermore, the nail driver is exemplified as the driving tool, but the exemplified grease supply structure can also be applied to other driving tools, e.g. a tacker that is driven by compressed air.

What is claimed is:

1. A driving tool, comprising:

a housing;

a cylinder that (1) is housed within the housing and (2) has a longitudinal axis;

a head valve that is located both on an outer peripheral circumference of the cylinder and on an inner peripheral circumference of the housing so as to be capable of reciprocating along the longitudinal axis;

an elastic member guide that is (1) between the head valve and a working end of the driving tool and (2) located both on the outer peripheral circumference of the cylinder and on the inner peripheral circumference of the housing;

an elastic member that is between the head valve and the elastic member guide; and a plurality of seal members for preventing air leakage between the housing and the head valve and between the cylinder and the head valve;

wherein the elastic member guide includes a plurality of grease reservoirs that are open in a direction toward the head valve.

2. The driving tool according to claim 1, wherein, the plurality of grease reservoirs comprise a first grease reservoir on an outer peripheral circumference of the elastic member guide and a second grease reservoir on an inner peripheral circumference of the elastic member guide.

3. The driving tool according to claim 2, wherein, the elastic member guide includes an elastic member holding portion for holding the elastic member, wherein:

the head valve is biased in a direction to be spaced apart from the elastic member guide by the elastic member; and the elastic member holding portion is disposed in an alternating manner with the first grease reservoir and the second grease reservoir in the circumferential direction of the elastic member guide.

4. The driving tool according to claim 2, wherein, the head valve includes a third grease reservoir on the outer peripheral circumference of the head valve and open in a direction toward the elastic member guide.

5. The driving tool according to claim 4, further comprising, a first recess on the inner peripheral circumference of the housing; and a scraping claw on the head valve, wherein:

the first recess straddles the first grease reservoir and the third grease reservoir when the head valve is brought into contact with the elastic member guide; and the scraping claw protrudes outwards in a radial direction of the head valve on a side facing the elastic member guide.

6. The driving tool according to claim 2, further comprising, a second recess that is on the outer peripheral circumference of the cylinder and is adjacent to the second grease reservoir, wherein, the second recess extends in a direction from the elastic member guide toward the head valve.

7. The driving tool according to claim 6, further comprising, a third recess that is in the head valve and is adjacent to the second recess when the head valve is brought into contact with the elastic member guide.

8. The driving tool according to claim 1, further comprising, a variable pressure chamber in the housing for supplying air serving to return the head valve to an initial position, the variable pressure chamber being open with respect to fluid communication with the plurality of grease reservoirs.

9. The driving tool according to claim 1, wherein, each of the plurality of grease reservoirs is in a section of the elastic member guide that is separate from another section of the elastic member guide that houses part of the elastic member.

10. The driving tool according to claim 2, wherein, a groove length of the first grease reservoir in a direction parallel to the longitudinal axis is larger than a groove length of the second grease reservoir in the direction.

11. A driving tool, comprising:

a cylindrical housing with a longitudinal axis;

a cylinder that is housed within the housing along the longitudinal axis;

a head valve that is located both on an outer peripheral circumference of the cylinder and an inner peripheral circumference of the housing so as to be capable of reciprocating along the longitudinal axis;

a spring guide that is (1) between the head valve and a working end of the driving tool, (2) extends in the circumferential direction, forming a complete circumference, and (3) located both on the outer peripheral circumference of the cylinder and on the inner peripheral circumference of the housing;

a plurality of compression springs that are between the head valve and of the spring guide; and a plurality of seal members for preventing air leakage between the housing and the head valve and between the cylinder and the head valve;

wherein the spring guide includes a plurality of grease reservoirs that (1) are open in a direction toward the head valve and (2) include a plurality of first grease reservoirs on an outer peripheral circumference of the spring guide and a plurality of second grease reservoirs on an inner peripheral circumference of the spring guide.

12. The driving tool according to claim 11, wherein, the spring guide includes a plurality of spring holding portions for holding the compression springs; and the head valve is biased in a direction to be spaced apart from the spring guide by the plurality of compression springs and is biased by compressed air within the housing.

13. The driving tool according to claim 12, wherein:

the number of the plurality of first and second grease reservoirs is equal;

the first and second grease reservoirs are located at equally spaced apart intervals along the circumferential length of the spring guide; and the first and second grease reservoirs are spaced apart radially, alternating in circumferential placement with the plurality of spring holding portions.

14. The driving tool according to claim 11, wherein each of the plurality of first grease reservoirs is a groove in the spring guide such that the width of the groove in the circumferential direction is smaller at a radial outermost end of the groove versus a radial innermost end of the groove, where the circumferential width is larger.

15. The driving tool according to claim 11, wherein, a groove length of each of the plurality of first grease reservoirs in a direction parallel to the longitudinal axis is larger than a groove length of each of the plurality of second grease reservoirs in the direction.

16. The driving tool according to claim 11, wherein, each of the plurality of first and second grease reservoirs is in a section of the spring guide that is separate from another section of the spring guide that houses part of the plurality of compression springs.

* * * * *